US008398213B2

(12) United States Patent
Uezawa

(10) Patent No.: US 8,398,213 B2
(45) Date of Patent: Mar. 19, 2013

(54) LIQUID EJECTING HEAD UNIT

(75) Inventor: Haruhisa Uezawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/230,383

(22) Filed: Sep. 12, 2011

(65) Prior Publication Data

US 2012/0069097 A1 Mar. 22, 2012

(30) Foreign Application Priority Data

Sep. 22, 2010 (JP) ..... 2010-211697

(51) Int. Cl.
*B41J 2/05* (2006.01)

(52) U.S. Cl. ..... 347/65

(58) Field of Classification Search ..... 347/54, 347/56, 63, 65

See application file for complete search history.

(56) References Cited

U.S. PATENT DOCUMENTS 7,207,662 B2 * 4/2007 Shin et al. ..... 347/63
2009/0251505 A1 10/2009 Arimura

FOREIGN PATENT DOCUMENTS

JP 2009-262543 11/2009

* cited by examiner

*Primary Examiner* — An Do
(74) *Attorney, Agent, or Firm* — Workman Nydegger

(57) ABSTRACT

A liquid ejecting head unit includes a flow path unit including a flow path communicating with a plurality of nozzles, a head case in which a common liquid flow path for supplying liquid to the flow path of the flow path unit is formed and to which the flow path unit is bonded, a flow path member which is bonded to the head case at the side opposite to the side to which the flow path unit is bonded and includes an upstream-side flow path for supplying liquid to the common liquid flow path, a heater which is mounted on a side face of the head case and is capable of generating heat, and a metal plate a portion of which is bonded to the heater and other portions of which are opposed to a portion of the flow path member.

6 Claims, 8 Drawing Sheets

LIQUID EJECTING HEAD UNIT

The entire disclosure of Japanese Patent Application No: 2010-211697, filed Sep. 22, 2010 is expressly incorporated by reference herein.

BACKGROUND

1. Technical Field

The present invention relates to a liquid ejecting head unit which applies pressure fluctuation to pressure chambers communicating with nozzles so as to eject liquid in the pressure chambers through nozzles, such as an ink jet recording head.

2. Related Art

Liquid ejecting heads which cause pressure fluctuation on liquid in pressure chambers so as to eject the liquid through nozzles in a form of liquid droplets include an ink jet recording head (hereinafter, simply referred to as recording head) used in an image recording apparatus such as an ink jet recording apparatus (hereinafter, simply referred to as printer), a color material ejecting head used for manufacturing a color filter such as a liquid crystal display, an electrode material ejecting head used for forming an electrode such as an organic electro luminescence (EL) display and a field emission display (FED), a bioorganic compound ejecting head used for manufacturing a biochip, and the like, for example.

For example, as the above recording head, there is a recording head which is configured by attaching a flow path unit, an actuator unit, and the like to a head case made of a resin. A series of liquid flow path from a reservoir to nozzles through pressure chambers is formed on the flow path unit. The actuator unit has pressure generation elements which can change volumes of the pressure chambers. A nozzle plate on which a plurality of nozzles are opened is bonded to the flow path unit.

Viscosity of liquid to be ejected from such recording head, which is suitable for being ejected therefrom, is approximately 4 mPa·s at a normal temperature, for example. The viscosity of the liquid has a correlation with temperature. That is, as the temperature is lower, the viscosity tends to be higher. In contrast, as the temperature is higher, the viscosity tends to be lower. Further, for example, there is a case where the recording head is used for an application in which liquid in a so-called high viscosity region of equal to or higher than 8 mPa·s at the normal temperature, such as ultraviolet curable ink, is ejected, for example. Therefore, a recording head which includes a heater on a head case for heating liquid in order to set viscosity of liquid to be ejected through nozzles to a value suitable for being ejected regardless of an environmental temperature has been known. In addition, a recording head in which such heater abuts against a head cover for protecting a nozzle plate so as to transfer heat to the nozzle plate through the head cover so that liquid in the recording head is heated has been proposed (for example, see JP-A-2009-262543).

In the recording head as described above, when a distance of a flow path formed in the recording head is short (for example, when the recording head is small in size), liquid cannot be sufficiently heated because liquid flowing from the upstream side at the time of the liquid ejection passes through the recording head for a short period of time. In order to solve the problem, a liquid ejecting head unit having a configuration in which a heater is also provided on a flow path member located at the upstream side with respect to the recording head has been developed. However, in such liquid ejecting head unit, since a plurality of heaters are provided, a configuration thereof has become complicated and cost has been increased.

SUMMARY

An advantage of some aspects of the invention is to provide a liquid ejecting head unit which can apply heat to a flow path at the upstream side with respect to a recording head with a simple configuration.

A liquid ejecting head unit according to an aspect of the invention includes a flow path unit including a flow path communicating with a plurality of nozzles, a head case in which a common liquid flow path for supplying liquid to the flow path of the flow path unit is formed and to which the flow path unit is bonded, a flow path member which is bonded to the head case at the side opposite to the side to which the flow path unit is bonded and includes an upstream-side flow path for supplying liquid to the common liquid flow path, a heater which is mounted on a side face of the head case and is capable of generating heat, and a metal plate a portion of which is bonded to the heater and other portions of which are opposed to a portion of the flow path member.

With this configuration, the heater mounted on the head case is bonded to the metal plate which is opposed to a portion of the flow path member. Therefore, heat of the heater can be transferred to the metal plate so that liquid in the flow path of the flow path member can be heated by using the heat of the metal plate. With this, temperature fluctuation of liquid in the liquid ejecting head can be further stabilized. As a result, unevenness of viscosity of the liquid in the liquid ejecting head can be suppressed so that reliability of the liquid ejecting head can be enhanced. Further, a heater is not required to be separately provided on the flow path member. Therefore, the liquid ejecting head unit can be easily manufactured and manufacturing cost thereof can be reduced.

In the above configuration, it is preferable that the liquid ejecting head unit further include a heat-insulating member which covers the metal plate at an outer side of the metal plate.

With this configuration, atmosphere in a space covered by the heat-insulating member can be heated with heat of the metal plate more efficiently and a heat-retention property is enhanced. Therefore, unevenness of temperature of the flow path member can be suppressed and temperature of liquid in the flow path member can be made uniform.

In the above configuration, it is preferable that a heat dissipation member which dissipates heat of the metal plate into a space covered by the heat-insulating member be provided on the metal plate.

With this configuration, heat of the metal plate can be made easy to be transferred to atmosphere and the atmosphere in the space covered by the heat-insulating member can be made easy to be heated.

Further, it is preferable that at least one slit be opened on the metal plate at a region opposed to a boundary between the flow path member and the head case.

With this configuration, a heat transfer mode from the side of the head case of the metal plate to the side of the flow path member can be controlled with the slit. For example, no slit is provided on a portion corresponding to a region on the flow path member, which is difficult to be heated, so that heat can be made easy to be transferred to the region. On the other hand, the slit is provided on a portion corresponding to a region on the flow path member, which is easy to be heated, so that heat can be made difficult to be transferred to the region. With this, unevenness of the temperature of the flow path member can be suppressed and the temperature of liquid in the flow path member can be made more uniform.

In the above configuration, it is preferable that a plurality of slits be arranged in a row on the metal plate along the boundary between the flow path member and the head case and a length of the slit opened at the center in a direction that the slits are arranged in a row be made longer than lengths of the slits opened at both ends in the same direction.

With this configuration, heat is easily transferred from the side of the head case to the side of the flow path member at both ends of the metal plate, which are relatively difficult to be heated. On the other hand, heat transfer from the side of the head case to the side of the flow path member is restricted at the center of the metal plate, which is relatively easy to be heated. With this, unevenness of the temperature of the flow path member can be suppressed and the temperature of liquid in the flow path member can be made more uniform.

Further, it is preferable that each slit be provided at a position deviated from a virtual extended line of the common liquid flow path in the direction that the slits are arranged in a row.

With this configuration, heat is easy to be transferred from the side of the head case to the side of the flow path member on the portion of the metal plate, which is opposed to the common liquid flow path. On the other hand, heat transfer from the side of the head case to the side of the flow path member is restricted on portions other than the portion opposed to the common liquid flow path. With this, liquid to be supplied from the side of the flow path member to the side of the common liquid flow path can be positively heated.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
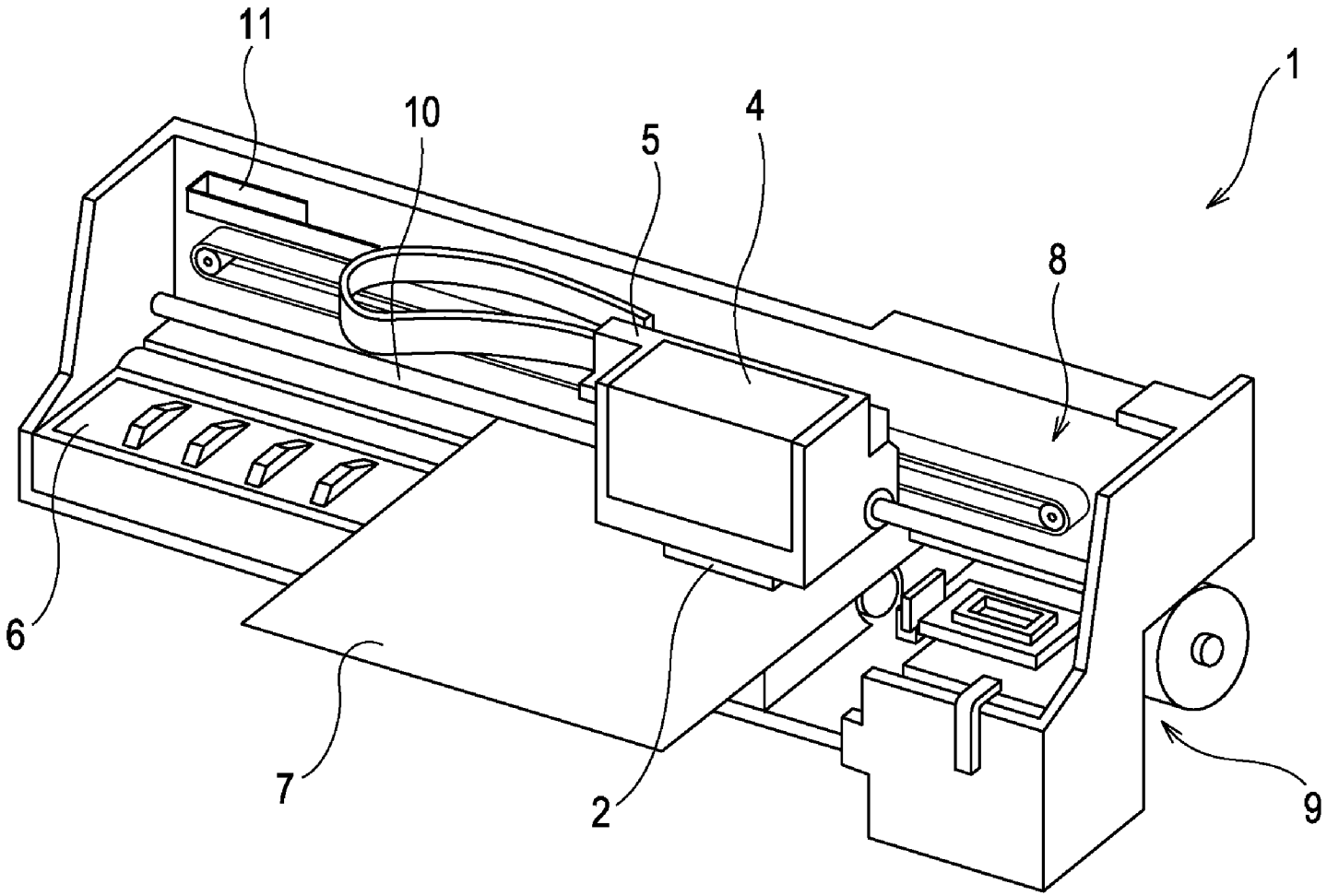
FIG. 1 is a perspective view illustrating a printer.

Hereinafter, the best mode for carrying out the invention is described with reference to accompanying drawings. In the following embodiments, various limitations are made as preferable specific examples of the invention. However, the scope of the invention is not limited to these embodiments unless description for limiting the invention is specifically made in the following description. Further, in the following description, an ink jet recording apparatus 1 (hereinafter, simply referred to as printer) as illustrated in FIG. 1 is described as an example of a liquid ejecting apparatus.

The printer 1 is schematically configured as follows. An ink jet recording head unit 2 (hereinafter, simply referred to as recording head unit) as one type of a liquid ejecting head unit is attached to the printer 1. The printer 1 includes a carriage 5, a platen 6, a carriage movement mechanism 8, a paper feeding mechanism 9, and the like. The recording head unit 2 and an ink cartridge 4 are attached to the carriage 5. The platen 6 is arranged at the lower side of the recording head unit 2. The carriage movement mechanism 8 moves the carriage 5 on which the recording head unit 2 is mounted in a paper width direction of a recording paper 7 (one type of a landed target on which liquid ejected through nozzles 38 lands). The paper feeding mechanism 9 transports the recording paper 7 in a paper feeding direction perpendicular to the paper width direction. It is to be noted that the paper width direction corresponds to a main scanning direction (reciprocating direction of the recording head unit 2) and the paper feeding direction corresponds to a sub scanning direction (that is, direction perpendicular to the scanning direction of the recording head unit 2).

The carriage 5 is attached in a state of being axially supported by a guide rod 10 which is bridged in the main scanning direction. The carriage 5 is configured so as to move in the main scanning direction along the guide rod 10 with an operation of the carriage movement mechanism 8. A position of the carriage 5 in the main scanning direction is detected by a linear encoder 11 and the detected signal is transmitted to a controller (not illustrated) as positional information. With this, the controller can control a recording operation (ejection operation) and the like by the recording head unit 2 while recognizing a scanning position of the carriage 5 (recording head unit 2) based on the positional information from the linear encoder 11.

The recording head unit 2 is attached to a lower portion of the carriage 5 (at the side of the recording paper 7 at the time of the recording operation). Further, the ink cartridge 4 storing ink (one type of liquid) is attached to the carriage 5 in a detachable manner. Further, the recording head unit 2 has a sub tank 13 for storing ink at an upper portion thereof. The sub tank 13 communicates with an inner portion of the ink cartridge 4 so that ink in the ink cartridge 4 can be introduced into the recording head unit 2.

Figure 2:
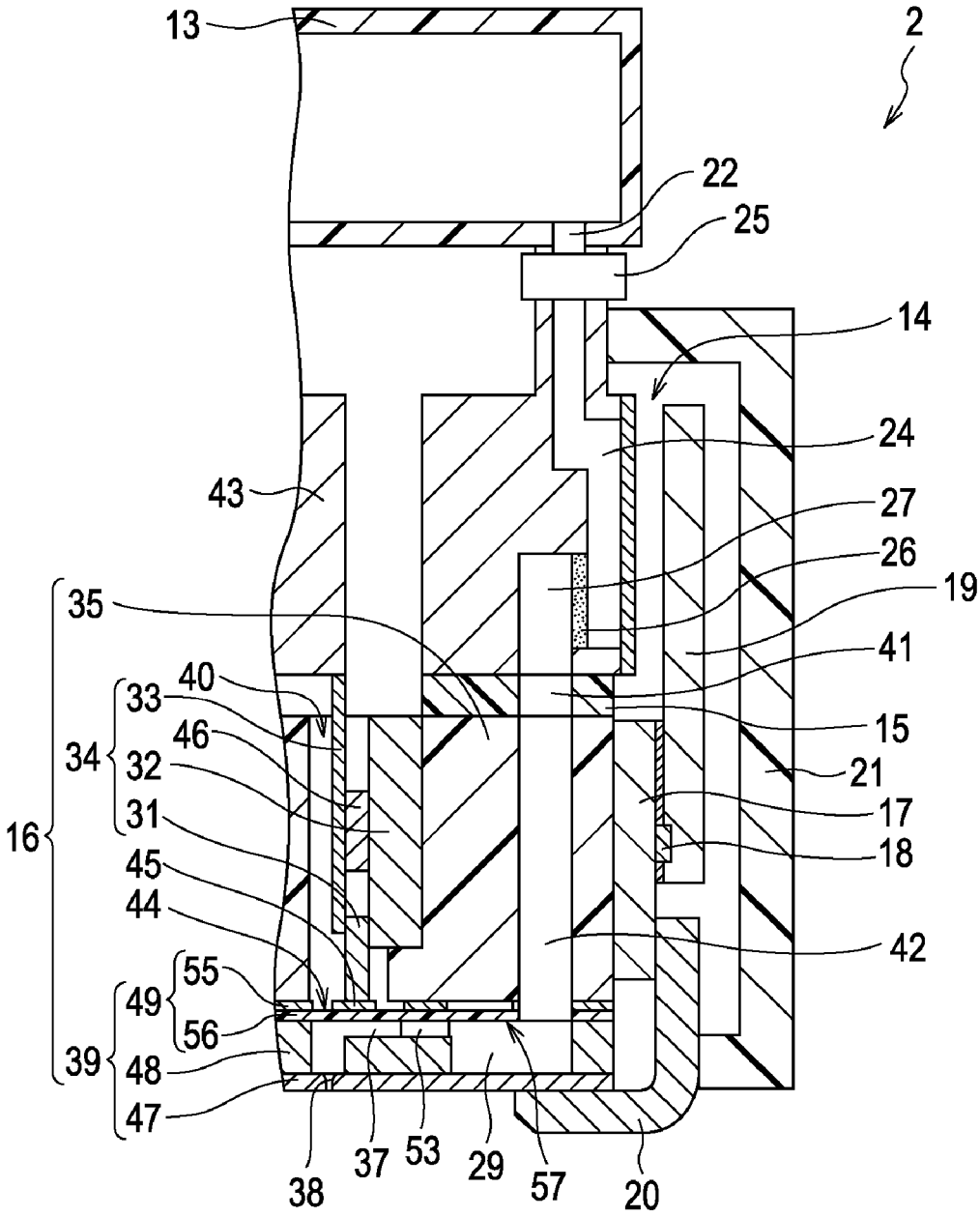
FIG. 2 is a cross-sectional view illustrating the main portion of a liquid ejecting head unit according to a first embodiment.
Figure 3:
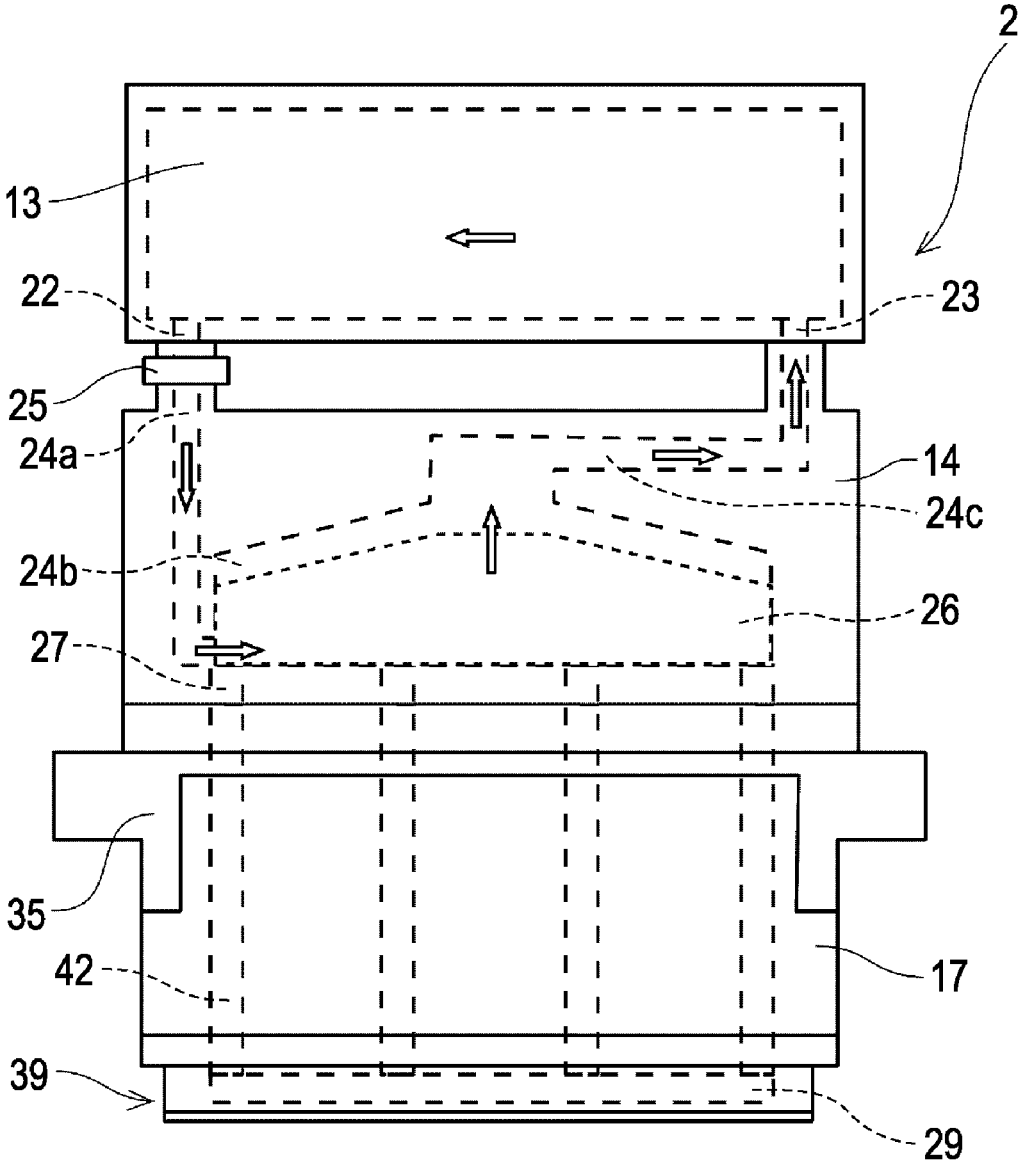
FIG. 3 is a front view illustrating the liquid ejecting head unit in a state where a metal plate, a head cover, and a heat-insulating member are detached according to the first embodiment.
Figure 4:
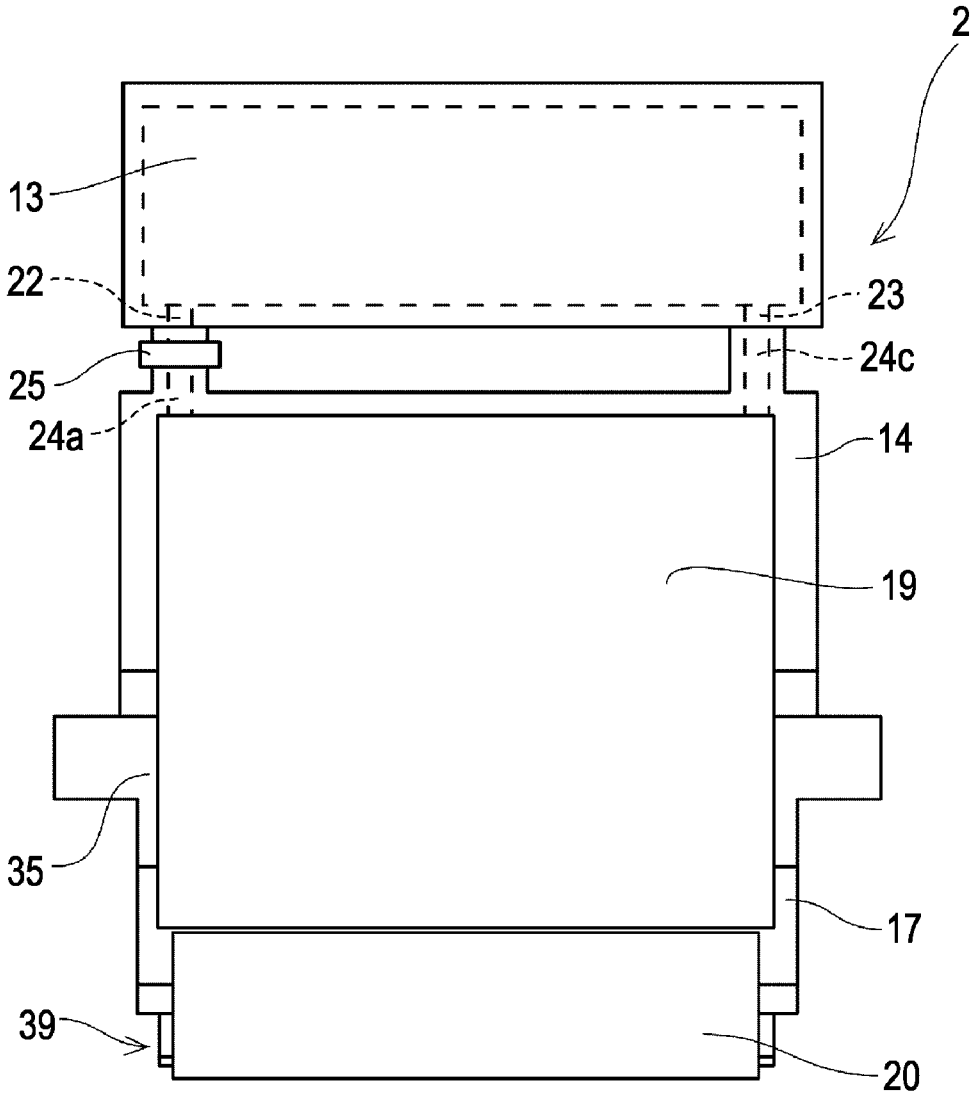
FIG. 4 is a front view illustrating the liquid ejecting head unit in a state where the heat-insulating member is detached according to the first embodiment.

Next, a configuration of the recording head unit 2 is described in detail. FIG. 2 is a cross-sectional view illustrating the main portion of the recording head unit 2. FIG. 3 is a front view illustrating the recording head unit 2 in a state where a metal plate 19, a head cover 20, and a heat-insulating member 21, which will be described later, are detached. FIG. 4 is a front view illustrating the recording head unit 2 in a state where the heat-insulating member 21 is detached (a state where the metal plate 19 and the head cover 20 are attached to the recording head unit 2 in the state of FIG. 3). The recording head unit 2 in the embodiment includes the sub tank 13, a flow path member 14, an ink jet recording head 16 (hereinafter, simply referred to as recording head), a heater 17 and a thermistor 18, the head cover 20, the metal plate 19, and the heat-insulating member 21. The flow path member 14 is connected to a lower portion of the sub tank 13. The ink jet recording head 16 is connected to a lower portion of the flow path member 14 through a connection member 15. The heater 17 and the thermistor 18 are mounted on a side face of the recording head 16. The head cover 20 protects a lower portion of the recording head 16. The metal plate 19 is connected to a side face of the heater 17. The heat-insulating member 21 covers an outer side of the metal plate 19. It is to be noted that the recording head unit 2 in the embodiment is symmetrical in a cross section (see, FIG. 2) perpendicular to the main scanning direction. Therefore, a configuration at one side thereof is described in the following description and a configuration at the other side which is symmetrical to the one side is not described.

The sub tank 13 is a hollow member having a box shape, which is made of a resin or the like. The sub tank 13 communicates with the ink cartridge 4 located at the upper side thereof through a liquid introduction needle (not illustrated) and the like. Therefore, ink in the ink cartridge 4 is introduced to and stored in the sub tank 13. Further, an outlet port 22 and an inlet port 23 which communicate with a circulation flow path 24 of the flow path member 14, which will be described later, are opened at lower portions of the sub tank 13. Therefore, ink in the sub tank 13 can be introduced to the flow path member 14 through the outlet port 22 and ink in the flow path member 14 can be introduced to the sub tank 13 through the inlet port 23.

The flow path member 14 is a member having a box shape, which is connected to the lower portion of the sub tank 13. The flow path member 14 includes the circulation flow path 24, a pump 25, a filter 26, and a plurality of (four in the embodiment, see, FIG. 3) communicating paths 27. The circulation flow path 24 is formed in the flow path member 14. The pump 25 is attached to a middle of the circulation flow path 24. The filter 26 is mounted in the circulation flow path 24. The communicating paths 27 communicate with the circulation flow path 24 through the filter 26. The circulation flow path 24 is a flow path in which ink can circulate in a plane parallel with the metal plate 19, which will be described later, through the sub tank. The circulation flow path 24 is constituted by a supply flow path 24*a*, a filter mounting portion 24*b*, and a crank-form discharge flow path 24*c*. The supply flow path 24*a* communicates with the outlet port 22 of the sub tank 13 and extends to the lower side (to the side of the recording head 16) from the outlet port 22. The filter mounting portion 24*b* communicates with a lower end of the supply flow path 24*a* and is a flow path having a wide width such that a lower side of the filter mounting portion 24*b* is aligned with a length of a reservoir 29, which will be described later. A lower end of the discharge flow path 24*c* communicates with an upper portion of the filter mounting portion 24*b* and an upper end thereof communicates with the inlet port 23 of the sub tank 13. Further, in the embodiment, the pump 25 is mounted on an upper portion of the supply flow path 24*a*. Ink is pushed out with pressure of the pump 25 so that the ink can be circulated. That is to say, ink in the sub tank 13 is introduced to the sub tank 13 again through the outlet port 22, the supply flow path 24*a*, the filter mounting portion 24*b*, the discharge flow path 24*c*, and the inlet port 23 so that the ink circulates in the plane parallel with the metal plate 19 (circulates in the direction of arrows in FIG. 3). It is to be noted that ink is circulated in the above manner by driving the pump 25 when the recording head 16 is in a standby state (when the recording operation is not being executed) so as to suppress viscosity of ink from increasing. Further, the filter 26 having substantially the same shape as the filter mounting portion 24*b* when seen from the front side is included in the filter mounting portion 24*b* (see, FIG. 3). The filter 26 is formed by finely weaving metal wires into a mesh pattern, for example. The filter 26 can filter ink to be transmitted from the side of the circulation flow path 24 to the side of the communicating paths 27. Further, the communicating paths 27 are flow paths one ends of which communicate with the filter mounting portion 24*b* through the filter 26 at the inner side of the flow path member 14 and the other ends of which communicate with common liquid flow paths 42, which will be described later. At the time of the recording operation, a portion of ink in the circulation flow path 24 is transmitted to the side of the recording head 16 through the communicating paths 27. It is to be noted that the circulation flow path 24 and the communicating paths 27 correspond to an upstream-side flow path according to the invention.

Next, a configuration of the recording head 16 is described in detail. The recording head 16 in the embodiment includes a vibrator unit 34, a head case 35, and a flow path unit 39. The vibrator unit 34 is formed by unitizing piezoelectric vibrators 31 (one type of pressure generation element), a fixing plate 32 and a flexible cable 33. The head case 35 can accommodate the vibrator unit 34. The flow path unit 39 forms a series of flow path from the reservoir 29 (common ink chamber) to the nozzles 38 through pressure generation chambers 37.

The head case 35 is a hollow member having a box shape, which is made of a resin such as an epoxy resin, for example. The flow path member 14 is bonded to an upper side of the head case 35 through the connection member 15 and the flow path unit 39 is bonded to a lower side of the head case 35 (at the side opposite to the side to which the flow path member 14 is bonded). Further, the common liquid flow paths 42 and an accommodation hollow portion 40 are formed in the head case 35. Upper ends of the common liquid flow paths 42 communicate with the communicating paths 27 of the flow path member 14 through connection flow paths 41 of the connection member 15. Lower ends of the common liquid flow paths 42 communicate with the reservoir 29 of the flow path unit 39. In the embodiment, four common liquid flow paths 42 are formed on a side face at one side (see, FIG. 3). It is to be noted that the connection member 15 is a sealing member having flexibility, which is formed by elastomer or the like. The common liquid flow paths 42 and the communicating paths 27 are connected to each other in a liquid tight state by the connection flow paths 41 of the connection member 15. Further, the accommodation hollow portion 40 is formed at the inner side with respect to the common liquid flow paths 42 and accommodates the vibrator unit 34 as one type of an actuator.

The vibrator unit 34 is constituted by the piezoelectric vibrators 31, the fixing plate 32, and the flexible cable 33. As will be described in detail, the piezoelectric vibrators 31 are members elongated in the longitudinal direction. A piezoelectric vibration plate as a base material is cut into a comb-tooth form having an extremely thin width of approximately several tens μm so as to form a plurality of piezoelectric vibrators 31. The piezoelectric vibrators 31 are constituted as longitudinal vibration-type piezoelectric vibrators which can expand and contract in the longitudinal direction. Each piezoelectric vibrator 31 is fixed in a so-called cantilever state where a fixing end of each piezoelectric vibrator 31 is bonded onto the fixing plate 32 and a free end thereof projects to the outer side with respect to a front edge of the fixing plate 32. Further, a tip of the free end of each piezoelectric vibrator 31 is bonded to an island portion 45 constituting a diaphragm portion 44 on the flow path unit 39 as will be described later. Further, one end of the flexible cable 33 is electrically connected to side faces of the fixing ends of the piezoelectric vibrators 31 at the side opposite to the fixing plate 32. The other end of the flexible cable 33 is connected to a control substrate 43. A control IC 46 is mounted on a surface of the flexible cable 33. Driving of the piezoelectric vibrators 31 and the like are controlled by the control substrate 43 and the control IC 46. Further, the fixing plate 32 which supports the piezoelectric vibrators 31 is formed by a plate material made of a metal having rigidity enough to receive a reactive force from the piezoelectric vibrators 31. In the embodiment, the fixing plate 32 is formed by a stainless steel plate having a thickness of approximately 1 mm.

Next, the flow path unit 39 is described. As illustrated in FIG. 2, the flow path unit 39 is constituted by a nozzle plate 47, a flow path formation substrate 48, and a vibration plate 49. The flow path unit 39 is bonded to the head case 35 at the side opposite to the nozzle plate 47. Further, the flow path unit 39 is formed as follows. That is, the nozzle plate 47 is arranged on one surface of the flow path formation substrate 48 and the vibration plate 49 is arranged on the other surface of the flow path formation substrate 48 at the side opposite to the nozzle plate 47 in a laminated manner. Then, the nozzle plate 47, the flow path formation substrate 48, and the vibration plate 49 are integrated with an adhesive or the like so as to form the flow path unit 39.

The nozzle plate 47 is a thin plate made of stainless steel on which a plurality of nozzles 38 are opened in a row at a pitch corresponding to dot formation density. In the embodiment, for example, 180 nozzles 38 are opened in a row and these nozzles 38 constitute a nozzle row.

The flow path formation substrate 48 is a plate-form member forming a series of ink flow path including the reservoir 29, ink supply ports 53, and pressure generation chambers 37. To be more specific, the flow path formation substrate 48 is a plate-form member on which a plurality of hollow portions serving as a plurality of pressure generation chambers 37 communicating with the nozzles 38 in a correspondence manner are formed and lined and hollow portions serving as a plurality of ink supply ports 53 corresponding to the pressure generation chambers 37 and the reservoir 29 are formed. At this time, the plurality of hollow portions serving as the plurality of pressure generation chambers 37 are formed and lined in a state of being partitioned by separation walls. The flow path formation substrate 48 in the embodiment is formed by performing an etching processing on a silicon wafer. The above pressure generation chambers 37 are formed as chambers elongated in the direction perpendicular to the direction that the nozzles 38 are arranged in a row (nozzle row direction). The ink supply ports 53 are formed as narrowed portions each having a small flow path width for communicating between the pressure generation chambers 37 and the reservoir 29. Further, the reservoir 29 communicates with the sub tank 13 at the upper side thereof through the common liquid flow paths 42, the connection flow paths 41, the communicating paths 27, and the circulation flow path 24. Further, the reservoir 29 communicates with the corresponding pressure generation chambers 37 through the ink supply ports 53. Therefore, the reservoir 29 can supply ink stored in the sub tank 13 to each pressure generation chamber 37. It is to be noted that a series of flow path constituted by the reservoir 29, the ink supply ports 53, and the pressure generation chambers 37 corresponds to a flow path in the invention.

The vibration plate 49 is a composite plate material having a dual structure obtained by laminating a resin film 56 such as poly phenylene sulfide (PPS) on a supporting plate 55 made of a metal such as stainless steel. Openings are made to pass through the vibration plate 49 in the vertical direction at positions corresponding to lower ends of the common liquid flow paths 42. With the openings, the common liquid flow paths 42 and the reservoir 29 are communicated with each other. Further, the vibration plate 49 has diaphragm portions 44 for sealing one opening faces of the pressure generation chambers 37 and changing volumes of the pressure generation chambers 37. In addition, a compliance portion 57 for sealing one opening face of the reservoir 29 is formed on the vibration plate 49. The diaphragm portions 44 are formed as follows. That is, an etching processing is performed on portions of the supporting plate 55, which correspond to the pressure generation chambers 37. Then, the portions are removed in a circular form and a plurality of island portions 45 to which the tips of the free ends of the piezoelectric vibrators 31 are bonded are formed to constitute the diaphragm portions 44. The island portions 45 are formed to have a block shape elongated in the direction perpendicular to the direction that the nozzles 38 are arranged in a row like the planar shapes of the pressure generation chambers 37. The resin film 56 around the island portions 45 functions as an elastic film. Further, on the vibration plate 49, the supporting plate 55 is removed with the etching processing in accordance with the opening shape of the reservoir 29 and only the resin film 56 is formed on a portion functioning as the compliance portion 57, that is, a portion corresponding to the reservoir 29.

As described above, the front end faces of the piezoelectric vibrators 31 are bonded to the island portions 45. Therefore, the free ends of the piezoelectric vibrators 31 are expanded and contracted so as to change the volumes of the pressure generation chamber 37. With the change of the volumes, pressure fluctuation is caused on ink in the pressure generation chambers 37. The recording head 16 ejects (discharges) ink droplets through the nozzles 38 by utilizing the pressure fluctuation.

Further, the heater 17 and the thermistor 18 are mounted on the side faces of the above recording head 16. To be more specific, the heater 17 is mounted using an adhesive (heat conductive silicon adhesive, heat conductive epoxy adhesive, or the like) having high heat conductivity (for example, equal to or higher than $2(W \cdot m^{-1} \cdot K^{-1})$) or the like so as to cover the entire of the side faces of the head case 35. At this time, the heater 17 covers the entire of the side faces of the head case 35 so as to be opposed to the plurality of common liquid flow paths 42. Further, the thermistor 18 is mounted on the center portion of the surface of the heater 17 with the same adhesive or the like. The heater 17 in the embodiment is formed into a sheet form (film form) sandwiching an electrically-heating wire (nickel alloy, stainless steel, or the like) with polyimide resins, or the like. The heater 17 generates heat by applying an electrical current to the electrically-heating wire. Ink in the common liquid flow paths 42 can be heated through the head case 35 with the heat generated by the heater 17. It is to be noted that the thermistor 18 is a temperature sensor for measuring a temperature of the heater 17. Therefore, an amount of generated heat of the heater 17 is adjusted based on the temperature information read by the thermistor 18 so that ink in the recording head 16 is adjusted to be at a predetermined temperature. As illustrated in FIG. 2, a lower portion of the metal plate 19, which will be described later, is adhered to and fixed to an outer surface of the heater 17. Further, a portion of the head cover 20 abuts against a lower portion of the outer surface of the heater 17 at a position where the head cover 20 does not interfere with the metal plate 19.

The head cover 20 is formed by a thin plate member made of a metal, for example. The head cover 20 is a protection member which protects side faces and a bottom of the flow path unit 39. An upper end of the head cover 20 abuts against the heater 17. Further, the head cover 20 is bent from the side of the heater 17 (the side of the side faces of the head case 35) to the side of the nozzle plate 47 by approximately 90 degrees so as to be fixed to ends of the nozzle plate 47. Therefore, heat of the heater 17 is transferred to the nozzle plate 47 through the head cover 20 so that the nozzle plate 47 is heated. With this, ink in the flow path unit 39 can be heated. It is to be noted that the head cover 20 is connected to the ground so as to prevent the nozzle plate 47 from being charged.

As illustrated in FIG. 2 and FIG. 4, the metal plate 19 is a flat plate-form member formed so as to have substantially the same width as that of the recording head 16. The metal plate 19 is arranged over the recording head 16 and the flow path member 14 in a state where a portion of the metal plate 19 is bonded to the heater 17 and other portions thereof are opposed to a portion (mainly, a surface which seals the circulation flow path 24) of the flow path member 14 in a non-contact manner. In the embodiment, the metal plate 19 and the heater 17 are opposed to each other such that a lower end of the metal plate 19 is located at a position which is slightly lower side with respect to the center of the heater 17 in the vertical direction. The metal plate 19 and the heater 17 are fixed to each other in the above state using an adhesive or the like having high heat conductivity. Further, an upper end of the metal plate 19 is located at the height which is substantially the same as that of an upper end of the flow path member 14. Accordingly, the most portions of the circulation flow path 24 are opposed to the metal plate 19. It is to be noted that a position of the metal plate 19 opposed to the thermistor 18 is slightly concaved so as not to interfere with the thermistor 18. In addition, a slight space is provided between the flow path member 14 and the metal plate 19 so that the flow path member 14 and the metal plate 19 do not make contact with each other.

Further, in the embodiment, the heat-insulating member 21 which covers the metal plate 19 at the outer side of the metal plate 19 is provided. The heat-insulating member 21 is formed by a member having low heat conductivity such as a resin and is attached so as to surround the entire side faces of the recording head 16 and the flow path member 14. To be more specific, the heat-insulating member 21 is arranged so as to be in parallel with the metal plate 19 with a space between the heat-insulating member 21 and the metal plate 19. An upper end of the heat-insulating member 21 is bent to the side of the flow path member 14 at a position opposed to the upper end of the flow path member 14 (at a position opposed to an upper end of the supply flow path 24*a* or the discharge flow path 24*c*) so as to abut against the flow path member 14. Further, a lower end of the heat-insulating member 21 is bent to the side of the flow path unit 39 at a position opposed to the flow path unit 39 so as to abut against the head cover 20. In the same manner, both ends of the heat-insulating member 21 in the nozzle row direction are also bent to the sides of the recording head 16 and the flow path member 14, respectively so as to abut thereagainst. Therefore, an air layer is formed between the heat-insulating member 21 and the metal plate 19 and between the heat-insulating member 21 and the head cover 20. In particular, the air layers are formed at both sides with respect to the metal plate 19 at a portion opposed to the flow path member 14. Since inner atmosphere (air layer) surrounded by the heat-insulating member 21 is separated from the outside air, a temperature of the atmosphere is kept to be as constant as possible. In the embodiment, heat of the heater 17 is transferred to the metal plate 19 and dissipated by the metal plate 19. Therefore, the air layer is kept at a temperature which is substantially the same as that of the heater 17. Further, the flow path member 14 is heated with the air layer so that ink in the circulation flow path 24 and the communicating paths 27 can be heated. For example, when the recording head 16 does not perform the recording operation, and so on, ink in the circulation flow path 24 is circulated and the inner portion of the circulation flow path 24 is heated. This makes it possible to further suppress viscosity of the circulating ink from increasing. In addition, when the recording head 16 performs the recording operation, since ink heated in the flow path member 14 is transferred to the side of the recording head 16. Accordingly, even if the heating time in the recording head 16 is short, the ink can be heated to a predetermined temperature.

Since the heater 17 mounted on the head case 35 and the metal plate 19 opposed to the flow path member 14 are bonded to each other, heat of the heater 17 can be transferred to the metal plate 19. Accordingly, the flow path member 14 can be heated by using the heat of the metal plate 19. Therefore, ink is heated from both sides of the head case 35 and the flow path member 14 so that the ink can be reliably heated regardless of flow rates of the ink. With this, a temperature of ink in the recording head 16 can be stabilized. As a result, unevenness of viscosity of ink in the recording head 16 can be suppressed so as to enhance reliability of the recording head 16. Further, the heater 17 is not required to be separately provided on the flow path member 14. Therefore, the recording head unit 2 can be easily manufactured and manufacturing cost thereof can be reduced. In addition, in the embodiment, the atmosphere in the space covered by the heat-insulating member 21 can be heated with heat of the metal plate 19 so that a heat-retention property is enhanced. Therefore, unevenness of the temperature of the flow path member 14 can be suppressed and the temperature of ink in the flow path member 14 can be made uniform. Further, since the metal plate 19 is arranged so as not to make contact with the flow path member 14, ink in the flow path member 14 can be prevented from being heated more than necessary.

A heat dissipation configuration by the metal plate 19 is not limited to that in the above first embodiment. For example, second to fourth embodiments as other embodiments are described with reference to FIG. 5 to FIG. 7.

Figure 5:
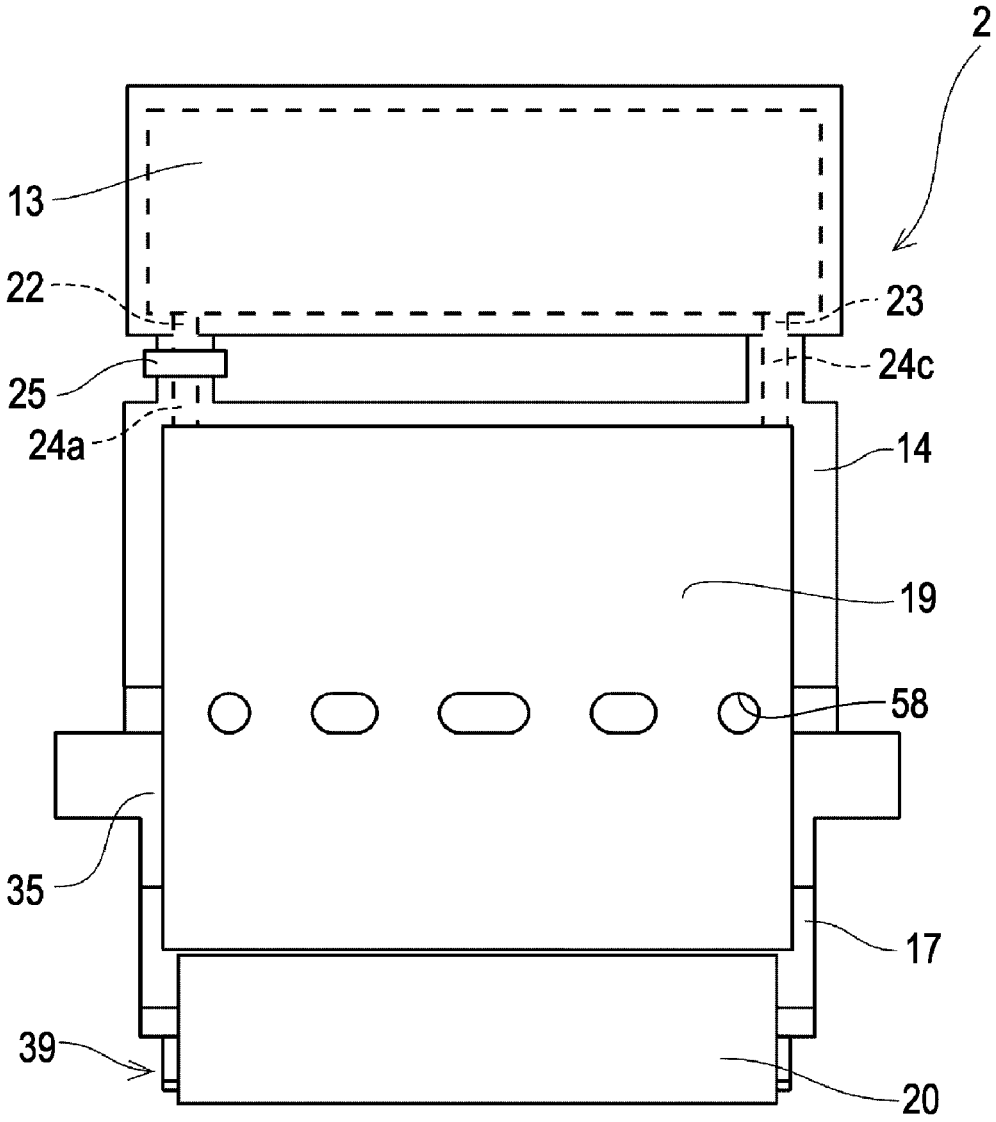
FIG. 5 is a front view illustrating a liquid ejecting head unit in a state where a heat-insulating member is detached according to a second embodiment.

At first, the second embodiment is described. On the metal plate 19 according to the second embodiment as illustrated in FIG. 5, a plurality of slits (passing through openings) 58 which pass through the metal plate 19 in the thickness direction are arranged in a row along a boundary between the flow path member 14 and the head case 35. Further, the slit 58 opened at the center in the direction that the slits are arranged in a row (in the embodiment, nozzle row direction) in the same direction is made longer than the slits 58 opened at both ends in the same direction. To be more specific, the slits 58 each having a width which is the substantially same as the thickness of the connection member 15 connecting the flow path member 14 and the recording head 16 are arranged at positions opposed to the connection member 15. In the embodiment, five slits 58 are opened and the length of one slit 58 located at the center is formed to be the longest. In the embodiment, the slit 58 at the center is an oblong hole elongated in the slit arrangement direction. Further, the slits 58 which are shorter than the slit 58 at the center are located at both sides of the slit 58 at the center and are formed into elliptic shapes laterally elongated in the slit arrangement direction in the embodiment. The slits 58 which are much shorter than these slits 58 are located at both ends of the metal plate 19. That is to say, the slits 58 located at both ends of the metal plate 19 are the shortest and are formed into substantially circular shapes in the embodiment. It is to be noted that other configurations are the same as those in the first embodiment and description thereof is not repeated.

As described above, the plurality of slits 58 are provided on the metal plate 19 and the slit 58 opened at the center is made to be longer than the slits 58 opened at both ends in the same direction. Therefore, heat is easily transferred from the side of the head case 35 to the side of the flow path member 14 at both ends of the metal plate 19 from which heat is easily released and which are relatively difficult to be heated. On the other hand, heat transfer from the side of the head case 35 to the side of the flow path member 14 is restricted at the center of the metal plate 19 which is relatively easy to be heated. With this, unevenness of the temperature of the flow path member 14 can be suppressed and the temperature of ink in the flow path member 14 can be made more uniform.

Figure 6:
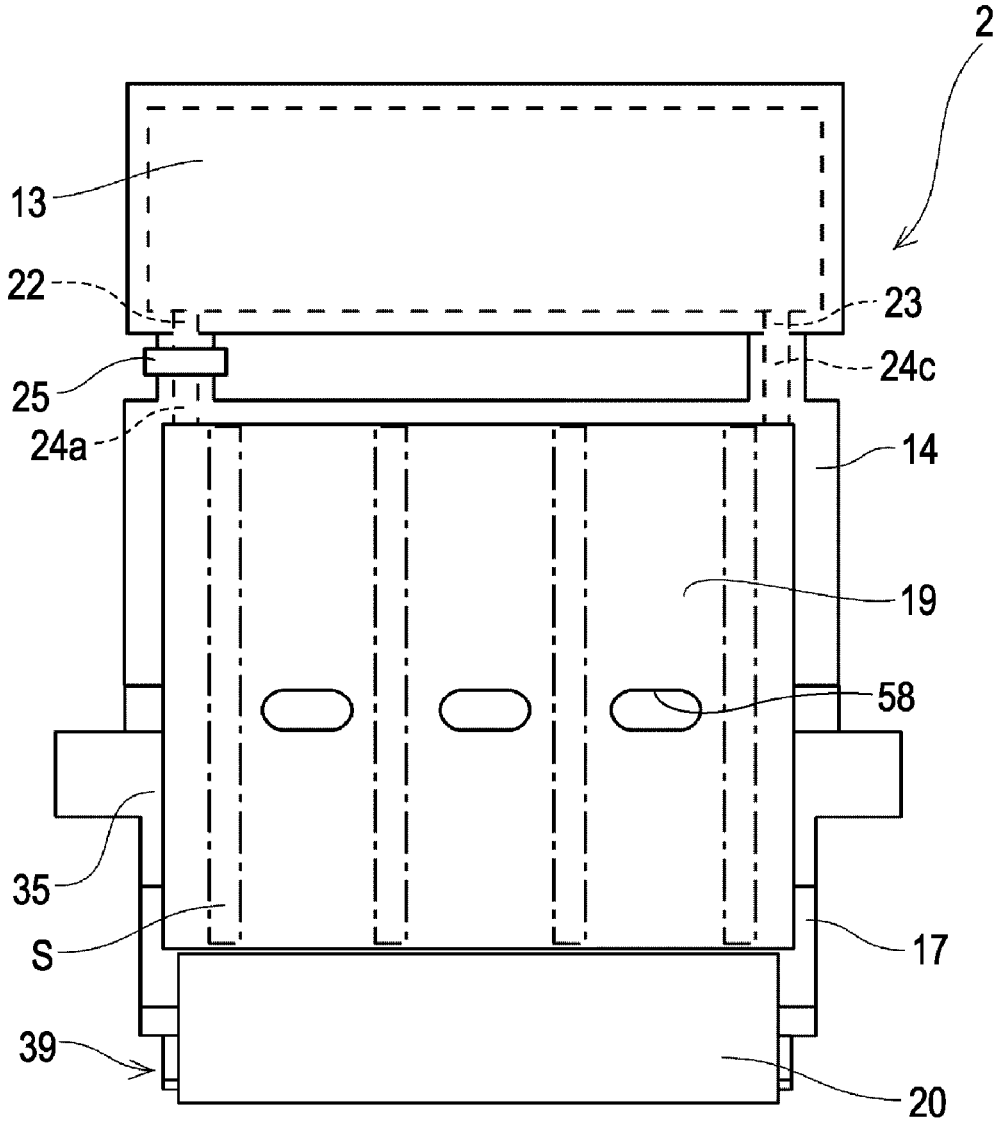
FIG. 6 is a front view illustrating a liquid ejecting head unit in a state where a heat-insulating member is detached according to a third embodiment.

As illustrated in FIG. 6, on the metal plate 19 according to the third embodiment, the slits 58 are provided at positions deviated from virtual extended lines of the common liquid flow paths 42 in the direction that the slits 58 are arranged in a row. It is to be noted that in FIG. 6, virtual extended lines S of the common liquid flow paths 42 on the metal plate 19 are indicated by dashed-dotted lines. Further, four common liquid flow paths 42 in the embodiment are provided on one side face of the head case 35 and four virtual extended lines S are illustrated in FIG. 6 so as to correspond to the common liquid flow paths 42. A plurality of slits 58 of the metal plate 19 are arranged in a row along a boundary between the flow path member 14 and the head case 35 and between the virtual extended lines S of the common liquid flow paths 42. In the embodiment, three slits 58 having the same size are provided so as to correspond to the four virtual extended lines S. It is to be noted that other configurations are the same as those in the first embodiment and description thereof is not repeated.

Heat of the heater 17 is taken away by the ink in the common liquid flow paths 42 at regions opposed to the common liquid flow paths 42 in a region of the metal plate 19, which is opposed to the heater 17. Therefore, the temperature tends to be lowered on the regions opposed to the common liquid flow paths 42 in comparison with other regions. As described above, the plurality of slits 58 are arranged in a row on the metal plate 19 and are provided at positions deviated from the virtual extended lines S of the common liquid flow paths 42. Therefore, in the above case, heat is easy to be transferred from the side of the head case 35 to the side of the flow path member at the regions of the metal plate 19, which are opposed to the common liquid flow paths 42. On the other hand, heat transfer from the side of the head case 35 to the side of the flow path member 24 is restricted on the regions other than the regions opposed to the common liquid flow paths 42. With this, ink to be supplied from the side of the flow path member 24 to the common liquid flow paths 42 (that is, ink passing through the communicating paths 27) can be positively heated.

It is to be noted that the plurality of silts 58 are not necessarily provided on the metal plate 19 and only one slit 58 may be provided thereon. That is to say, it is sufficient that at least one slit 58 is provided on the metal plate 19 at a region opposed to the boundary between the flow path member 14 and the head case 35. If the slit 58 is provided in such manner, heat transfer from the side of the head case 35 to the side of the flow path member 14 on metal plate 19 can be blocked by the slit 58. Therefore, a heat transfer mode on the metal plate 19 can be controlled. For example, no slit 58 is provided on a portion corresponding to a region on the flow path member 14, which is difficult to be heated (from which heat is easy to be released), so that heat can be made easy to be transferred to the region. On the other hand, the slit 58 is provided on a portion corresponding to a region on the flow path member 14, which is easy to be heated, so that heat can be made difficult to be transferred to the region. With this, unevenness of the temperature of the flow path member 14 can be suppressed and the temperature of ink in the flow path member 14 can be made more uniform.

Figure 7:
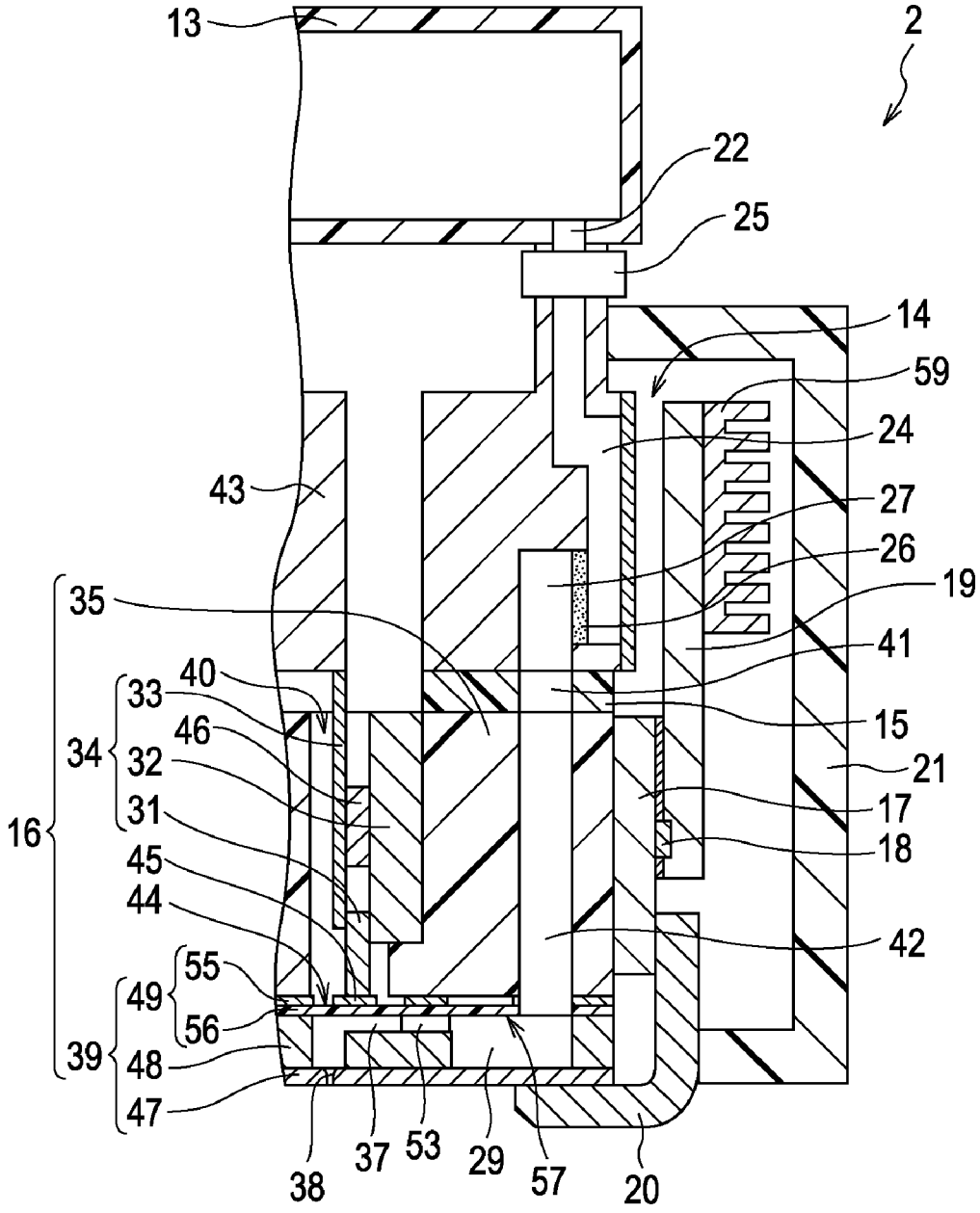
FIG. 7 is an enlarged cross-sectional view illustrating a liquid ejecting head unit according to a fourth embodiment.

As illustrated in FIG. 7, the metal plate 19 according to the fourth embodiment includes a heat dissipation member 59 which positively dissipates heat of the metal plate 19 into the space (air layer) covered by the heat-insulating member 21. To be more specific, the heat dissipation member 59 is attached to the surface of the metal plate 19 at the side of the heat-insulating member 21 and is held with a space between the heat dissipation member 59 and the heat-insulating member 21. Further, the heat dissipation member 59 is a member (heat sink) made of a metal or the like, which is easy to dissipate heat. A plurality of fins are formed on the heat dissipation member 59 in the embodiment. A contact area between the heat dissipation member 59 and the air layer is increased with the fins so that the heat dissipation member 59 is made easy to dissipate heat. In the embodiment, the heat dissipation member 59 is arranged on a region of the metal plate 19, which is opposed to the flow path member 14. However, the invention is not limited thereto. The heat dissipation member 59 may be arranged on the entire face of the metal plate 19. Further, other configurations are the same as those in the first embodiment and description thereof is not repeated.

The heat dissipation member 59 is provided on the metal plate 19 in the above manner in the fourth embodiment. Therefore, heat of the metal plate 19 can made easy to be transferred to atmosphere so that the atmosphere in the space covered by the heat-insulating member 21 can be made easy to be heated. With this, unevenness of the temperature of the flow path member 14 can be suppressed more desirably and the temperature of ink in the flow path member 14 can be made more uniform.

Figure 8:
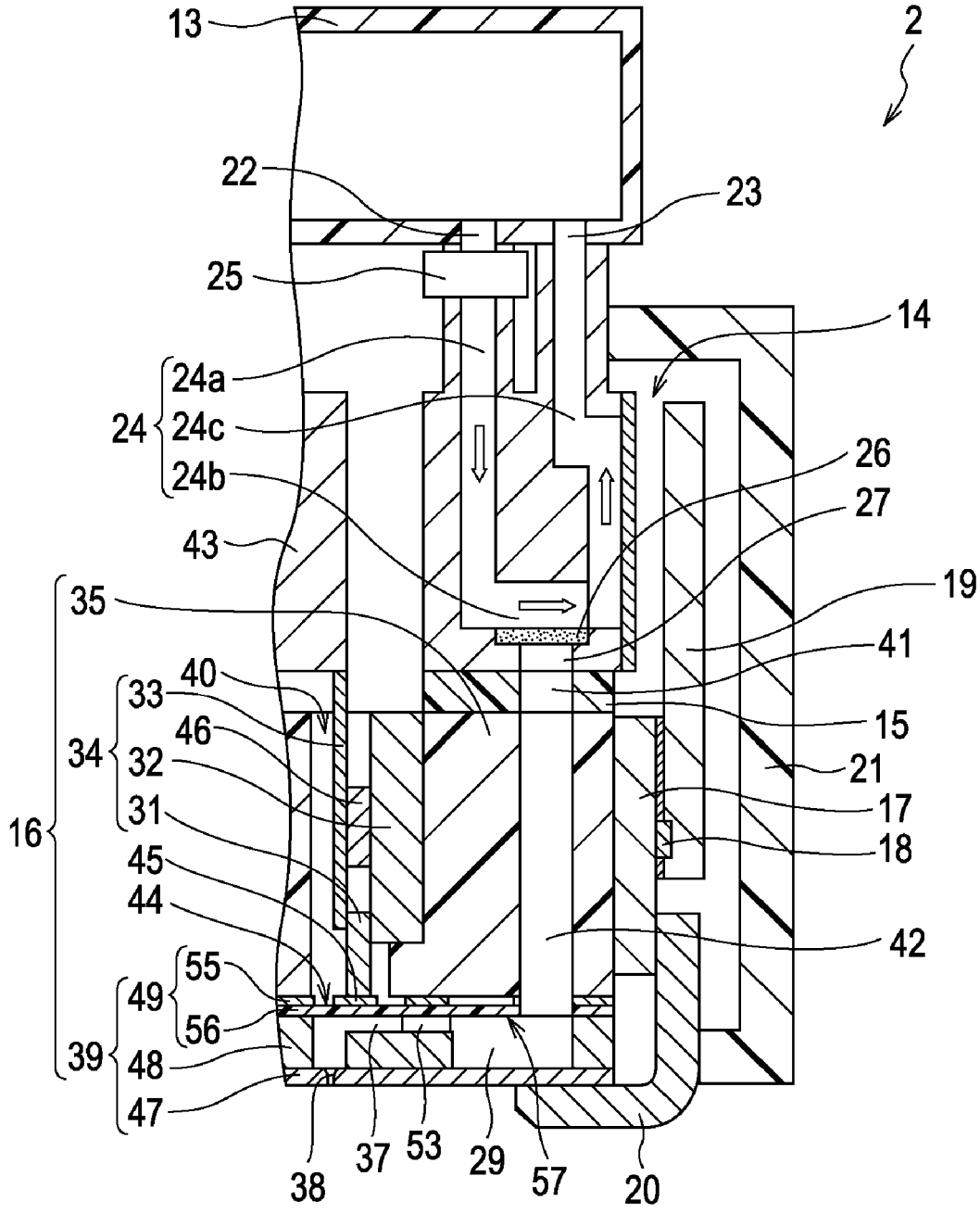
FIG. 8 is an enlarged cross-sectional view illustrating a liquid ejecting head unit according to a fifth embodiment.

A configuration of the circulation flow path 24 in the flow path member 14 is not limited to the above embodiment. For example, the fifth embodiment is illustrated in FIG. 8. The circulation flow path 24 according to the fifth embodiment is provided in a plane perpendicular to the metal plate 19 and one circulation flow path 24 is provided for one common liquid flow path 42. To be more specific, the outlet port 22 and the inlet port 23 are opened side by side on the sub tank 13 in the plane perpendicular to the metal plate 19. Further, each circulation flow path 24 is constituted by a supply flow path 24*a*, a filter mounting portion 24*b*, and a crank-form discharge flow path 24*c*. The supply flow path 24*a* communicates with the outlet port 22 of the sub tank 13 and extends to the lower side from the outlet port 22. The filter mounting portion 24*b* communicates with a lower end of the supply flow path 24*a* and extends in the direction perpendicular to the supply flow path 24*a*. A lower end of the discharge flow path 24*c* communicates with an end of the filter mounting portion 24*b* at the side opposite to the supply flow path 24*a* and an upper end thereof communicates with the inlet port 23 of the sub tank 13. Further, ink in the sub tank 13 is introduced to the sub tank 13 again through the outlet port 22, the supply flow path 24*a*, the filter mounting portion 24*b*, the discharge flow path 24*c*, and the inlet port 23 with the pump 25 mounted on an upper portion of the supply flow path 24*a* so that the ink circulates in the plane perpendicular to the metal plate 19 (circulates in the direction of arrows in FIG. 8). Further, the filter 26 is mounted on a bottom of the filter mounting portion 24*b*. In addition, the communicating path 27 communicating with the common liquid flow path 42 communicates with the bottom of the filter mounting portion 24*b* through the filter 26. The circulation flow path 24 and the communicating path 27 are formed for each common liquid flow path 42. It is to be noted that each circulation flow path 24 and each communicating path 27 correspond to an upstream-side flow path according to the invention. Further, other configurations are the same as those in the first embodiment and description thereof is not repeated.

Even if the plurality of circulation flow paths are provided in the flow path member 14 as described above, atmosphere in the space covered by the heat-insulating member 21 is heated with heat of the metal plate 19. Further, each flow path of the flow path member 14 can be heated through the atmosphere. With this, the plurality of flow paths in the flow path member 14 can be evenly heated so that temperatures of inks in the flow paths can be made uniform. Therefore, unevenness of the temperature in the recording head can be suppressed.

Further, in the above embodiments, the circulating flow path has been described as an example of the upstream-side flow path. However, the upstream-side flow path is not limited thereto. For example, the invention can be applied to a case where the sub tank and the recording head are connected to each other with an one-way flow path which does not circulate. In such case, a configuration in which the sub tank is not provided and the ink cartridge and the recording head are directly connected to each other can be employed. In addition, the ink cartridge may be provided on the outside of the carriage (frame side of the printer, or the like) (so-called off-carriage type). In this case, the ink cartridge and the sub carriage are connected to each other with a tube or the like so that ink in the ink cartridge is transferred to the side of the sub carriage. Further, a mechanism of heating ink can be provided on the flow path at the upstream side with respect to the flow path member to which the metal plate is opposed. In this case, since ink which has been already heated is flown into the flow path member, a configuration of the invention functions as a mechanism which keeps heat of ink in the flow path member.

Further, in the above embodiment, a piezoelectric vibrator in a so-called longitudinal vibration mode has been described as an example of the pressure generation unit. However, the pressure generation unit is not limited thereto. For example, the invention can be also applied to a case where a piezoelectric vibrator in a so-called flexural vibration mode or a heat generation element is used.

Further, the invention is not limited to the printer and may be also applied to various ink jet recording apparatuses such as a plotter, a facsimile machine, and a copying machine. Further, the invention may be also applied to liquid ejecting apparatuses other than the recording apparatuses. The liquid ejecting apparatuses include a display manufacturing apparatus, an electrode manufacturing apparatus, a chip manufacturing apparatus, and the like, for example.

What is claimed is:

1. A liquid ejecting head unit comprising:

a flow path unit including a flow path communicating with a plurality of nozzles;

a head case in which a common liquid flow path for supplying liquid to the flow path of the flow path unit is formed and to which the flow path unit is bonded;

a flow path member which is bonded to the head case at the side opposite to the side to which the flow path unit is bonded and includes an upstream-side flow path for supplying liquid to the common liquid flow path;

a heater which is mounted on a side face of the head case that is different from surfaces to which the flow path unit and the flow path member are bonded, the heater being capable of generating heat; and a metal plate a portion of which is bonded to the heater and other portions of which are opposed to a portion of the flow path member.

2. The liquid ejecting head unit according to claim 1, further including a heat-insulating member which covers the metal plate at an outer side of the metal plate.

3. The liquid ejecting head unit according to claim 2, wherein a heat dissipation member which dissipates heat of the metal plate into a space covered by the heat-insulating member is provided on the metal plate.

4. The liquid ejecting head unit according to claim 1, wherein at least one slit is opened on the metal plate at a region opposed to a boundary between the flow path member and the head case.

5. The liquid ejecting head unit according to claim 4, wherein a plurality of slits are arranged in a row on the metal plate along the boundary between the flow path member and the head case and a length of the slit opened at the center in a direction that the slits are arranged in a row is made longer than lengths of the slits opened at both ends in the same direction.

6. The liquid ejecting head unit according to claim 4, wherein each slit is provided at a position deviated from a virtual extended line of the common liquid flow path in the direction that the slits are arranged in a row.

* * * * *